US006955619B1

(12) United States Patent
Schutz et al.

(10) Patent No.: US 6,955,619 B1
(45) Date of Patent: Oct. 18, 2005

(54) TITANIUM HOCKEY STICK

(76) Inventors: Ronald W. Schutz, 410 Shadydale Dr., Canfield, OH (US) 44406; Alan L. Miller, 1228 Will-O-Wood, Hubbard, OH (US) 44425

( * ) Notice: Subject to any disclaimer, the term of this patent is extended or adjusted under 35 U.S.C. 154(b) by 5 days.

(21) Appl. No.: 10/813,141

(22) Filed: Mar. 29, 2004

(51) Int. Cl.[7] ..... A63B 59/14
(52) U.S. Cl. ..... 473/560; 473/561; 473/562
(58) Field of Search ..... 473/560–568

(56) References Cited

U.S. PATENT DOCUMENTS

| | | | | |
|---|---|---|---|---|
| 3,479,030 | A * | 11/1969 | Merola | 473/520 |
| 3,934,875 | A | 1/1976 | Easton et al. | |
| 4,124,208 | A | 11/1978 | Burns | |
| 5,028,464 | A | 7/1991 | Shigetoh | |
| 5,607,154 | A | 3/1997 | Meumann et al. | |
| 5,655,981 | A | 8/1997 | Reed | |
| 5,863,268 | A | 1/1999 | Birch | |
| 5,879,250 | A * | 3/1999 | Tahtinen et al. | 473/561 |
| 5,906,550 | A * | 5/1999 | Kingston | 473/320 |
| 6,001,035 | A | 12/1999 | Roberts | |
| 6,117,029 | A | 9/2000 | Kunisaki et al. | |
| 6,139,444 | A | 10/2000 | Renard et al. | |
| 6,354,960 | B1 | 3/2002 | Perryman et al. | |
| 6,364,792 | B1 | 4/2002 | Evanochko | |
| 6,431,996 | B1 | 8/2002 | Wright et al. | |
| 6,500,079 | B1 | 12/2002 | Tucker, Sr. | |
| 2001/0046910 | A1 * | 11/2001 | Sutherland | 473/564 |
| 2002/0119829 | A1 * | 8/2002 | Cheng | 473/316 |
| 2002/0128093 | A1 * | 9/2002 | Whayne | 473/520 |
| 2002/0198071 | A1 * | 12/2002 | Snow | 473/564 |
| 2003/0017884 | A1 * | 1/2003 | Masters et al. | 473/316 |

* cited by examiner

*Primary Examiner*—Mark S. Graham
(74) *Attorney, Agent, or Firm*—Sand & Sebolt

(57) ABSTRACT

A hockey stick shaft is a hollow, thin-walled tube formed of titanium or a titanium alloy. The tube wall has a thickness which may be uniform, tapered or stepped. The titanium or titanium alloy is of an alpha, a near-alpha, an alpha-beta or a highly-aged beta type. The titanium or titanium alloy has an elastic modulus greater than 13 million pounds per square inch (psi), a yield strength above 50,000 psi and a wall thickness ranging from 0.020 to 0.045 inches. An alternate hockey stick shaft has a titanium or titanium alloy core and exterior formed of a composite material. The titanium or titanium alloy core is of an alpha, a near-alpha, an alpha-beta or a beta type and has a yield strength above roughly 40,000 psi and a wall thickness ranging from 0.010 to 0.040 inches.

29 Claims, 3 Drawing Sheets

TITANIUM HOCKEY STICK

BACKGROUND OF THE INVENTION

1. Technical Field

The invention relates generally to hockey sticks. More particularly, the invention relates to a hockey stick having a light-weight shaft which is highly durable, impact-damage-resistant and dynamically responsive. Specifically, the invention relates to a thin-walled hockey stick shaft made of titanium or a titanium alloy.

2. Background Information

Wood has been the traditional material of construction for ice and street hockey sticks. As such, the hard wood, Northern white-ash, is typically used in solid form for stick shafting (shafts) and blades. This hard wood has been attractive for hockey sticks based on high availability, flexibility, strength, hardness, ease of manufacturability into sticks, and, especially, low relative cost.

Produced from a natural product, however, wood sticks inherently exhibit strong property directionality (i.e. texture), a relatively low elastic modulus, weak areas from defects and/or grain and composition inconsistencies, significant variability in durability and stiffness, and property and dimensional changes and/or warpage over time (instability). Furthermore, wood is highly susceptible to mechanical damage (cracking, splitting, chipping, denting) when impacted, especially when damage is imposed parallel to the grain direction. Wood sticks can become brittle at either temperature extreme, and/or over time as the natural moisture content of the wood diminishes (i.e., dries out). Flexure characteristics can change over time with use. Wood also possesses inherent energy dampening qualities, which act to reduce elastic energy transfer (snap) from the stick to the puck being shot.

Some of these limitations with wood hockey sticks have been alleviated over the years through the application of fiberglass and/or carbon fiber reinforced plastic layers and laminates applied around the wood core. Not only does the fiberglass outer layer retard moisture egress from the wood core to extend stick shelf-life, it offers improved impact damage and cracking resistance to the wood. Furthermore, the glass and/or carbon fiber type and lay pattern can be used to enhance and control wood shaft and/or blade stiffness and dynamic response. Unfortunately, this fiberglass laminated and reinforced wood design results in fairly stiff and heavy hockey sticks (e.g., ~660 grams for a one-piece stick).

In the pursuit to improve hockey stick durability, consistency, and achieve lower net weight, extruded hollow aluminum alloy shafts (thin-wall seamless rectangular tubulars) were introduced around the mid to late 1980's. With this design, a replaceable laminated wood blade is inserted (with hot glue) into the hosel end of the aluminum shaft. Aluminum alloys, such as the 7005 alloy typically used in tennis rackets and baseball bats, offered tempered yield strengths on the order of 45,000–50,000 pounds per square inch (psi), in combination with good flexibility (elastic modulus ~10.1 million psi) and a low density of 0.10 lb/in$^3$. In order to achieve the shaft stiffness and damage/impact tolerance required, these aluminum shafts were typically designed with 0.045–0.060" thick constant or tapered walls. As a result, modest shaft weight reductions on the order of 10–15% were achieved over wood. This metal shaft also featured performance consistency, long-term stability, and damage tolerance/life extension, compared to wood sticks. The integration of composite materials with aluminum to create "hybrid" shafts in the early 1990's provided further means to trim shaft weight, enhance shaft dynamic response/energy transfer, and adjust/control stiffness. Here again, glass- and/or carbon-reinforced plastic laminates and/or Kevlar (aramid) wraps were applied over aluminum tubular core reinforcements to control stiffness and create flex points along the shaft length.

Despite these shaft material/design advances, commercial production of aluminum alloy hockey stick shafts has recently been discontinued. Fundamentally, this occurred due to the commercial availability of even lighter, more dynamically responsive, and often lower priced single-piece or two-piece all-composite sticks. Aluminum's inherent combination of lower strength and modulus properties limited the ability to design lighter weight sticks with the durability to withstand the rigors of hockey play. These aluminum shafts were known to suffer out-of-plane permanent set (yielding from bending), denting, and cracking in hosel corners.

With their market entry in the mid-1990's, all-composite shafts and one-piece sticks today represent approximately two-thirds of the hockey stick market in North America. Despite prices which can range from 3–6 times that of wood stocks, the current market predominance of all-composite hockey sticks/shafts primarily stems from three basic performance features:

1. Lower weight: Composite shafts typically weigh 280–340 grams, or roughly 460–500 grams for a one-piece hockey stick. This represents a net weight reduction in the range of 25–37% over wood. Lighter weight translates into a faster and/or harder shot.
2. A wider range of stiffness: Typically, offense players prefer less-stiff (more flexible) shaft response for puck control and wrist-shots with quick snap. Stiffer sticks are generally favored by defensemen for slap-shots. Shaft stiffness is often commercially rated on the unofficial scale of 70–120 lb/in, related to the load to achieve a shaft mid-span deflection of one inch.
3. Improved, consistent energy transfer: Composite shafts/sticks exhibit enhanced elastic energy storage and transfer to the puck compared to wood shafts. This stems from reduced matrix dampening and the nature of glass- and/or carbon-fiber lay. Unlike wood, these flex and energy characteristics are highly controlled and consistent from stick to stick.

Despite these attractive performance features, inadequate durability and impact damage tolerance of these fiber-reinforced plastic composites represent their greatest limitations. Composites are well known for their minimal resistance to impact damage which can produce undetectable, internal mechanical damage to the composite (e.g., fiber-matrix separation). This internal damage is very sensitive to the degree and direction of impact, and the shape-hardness of the impacting body. Although composite shafts may utilize Kevlar outer sheet wraps to mitigate impact damage to the composite substrate, brittle, cracking failure of composite shafts is still life limiting. This lack of durability is very serious since each all-composite shaft currently typically retails for $70–100, and the one-piece composite stick is typically priced in the range of $170–200. This poor stick life cycle cost scenario has recently financially impacted professional hockey teams, where replacement composite stick budgets have skyrocketed. Less critical durability issues with composites include effects at extreme temperature limits. Repeated overheating of the shaft hosel area incurred during blade replacement procedure using hot glue can produce composite blistering and weakening, whereas very cold outdoor winter temperatures can make sticks more prone to brittle fracture.

U.S. Pat. No. 5,863,268 granted to Birch discloses a metal goalkeeper's hockey stick, which has a blade and shaft which are preferably formed of an aluminum alloy, but which may also be formed of a titanium alloy. However, the Birch hockey stick is specifically one used by a goalie or goaltender, which is completely different than that of a "player" hockey stick, that is, one used by the players (forward and defense men) other than the goalie. Goalie sticks and player sticks are not interchangeable with one another and indeed each would be completely inadequate if used in the stead of the other.

The goalie hockey stick is configured for a completely different purpose than the player hockey stick. The goalie stick is configured primarily for blocking shots or deflecting shots away and thus utilizes a substantially enlarged blade for that purpose, along with a substantially shortened shaft. By contrast, the player sticks are alternately used for maneuvering and/or passing the puck quickly while sometimes skating at high speeds; making wrist-shots with quick snap; and making slap-shots which launch the puck at high speed. Thus, sticks with various stiffness and flex characteristics are important in player sticks. Typically, forward or offensive players prefer less-stiff (more flexible) shaft response for puck control and wrist-shots with quick snap. Stiffer sticks are generally favored by defense men for slap-shots.

In keeping with the difference in purposes of the sticks, the blade of the goalie stick, as shown by Birch, has a horizontal portion and an upstanding portion which is substantially longer than (nearly twice as long as) the horizontal portion. In addition, the upstanding portion of the blade is roughly the same width as the horizontal portion. By contrast, the blade of the player stick has a relatively short upwardly extending portion, mainly for the purpose of providing a transition for connecting to the shaft. This upwardly extending portion is also substantially narrower than the horizontal portion of the player blade.

While the Birch shaft is a hollow tube, it is substantially shorter at approximately 32 inches than the shaft of the typical player hockey stick, which is roughly 50 inches, although this varies. Due in part to the relatively long upstanding portion of the goalie blade, a longer shaft is not suitable for use with the goalie stick. The substantially longer shaft of the player stick alone creates a completely different dynamic aspect from that of a goalie stick shaft. As a result of the distinct purpose and the correspondingly different size, the player stick shaft must incorporate various parameters quite distinct from those of the goalie stick shaft.

BRIEF SUMMARY OF THE INVENTION

The present invention provides a player hockey stick shaft comprising an elongated one-piece wall forming a titanium or titanium alloy hollow tube having an upper end and a lower end adapted to receive a player hockey stick blade therein.

One embodiment features the wall forming the tube with a thickness ranging from 0.020 to 0.045 inches; and the titanium or titanium alloy having an elastic modulus above 13 million pounds per square inch and a yield strength above 50,000 pounds per square inch.

The present invention also provides a player hockey stick shaft comprising an elongated titanium or titanium alloy core having an outer surface, an upper end and a lower end adapted to connect to a player hockey stick blade; and a composite material connected to the outer surface of the core.

One embodiment features the core having a wall with a thickness ranging from 0.010 to 0.040 inches and the titanium or titanium alloy having a yield strength above 40,000 pounds per square inch.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numerals refer to similar parts throughout the specification.

DETAILED DESCRIPTION OF THE INVENTION

Figures 1, 2, 3:
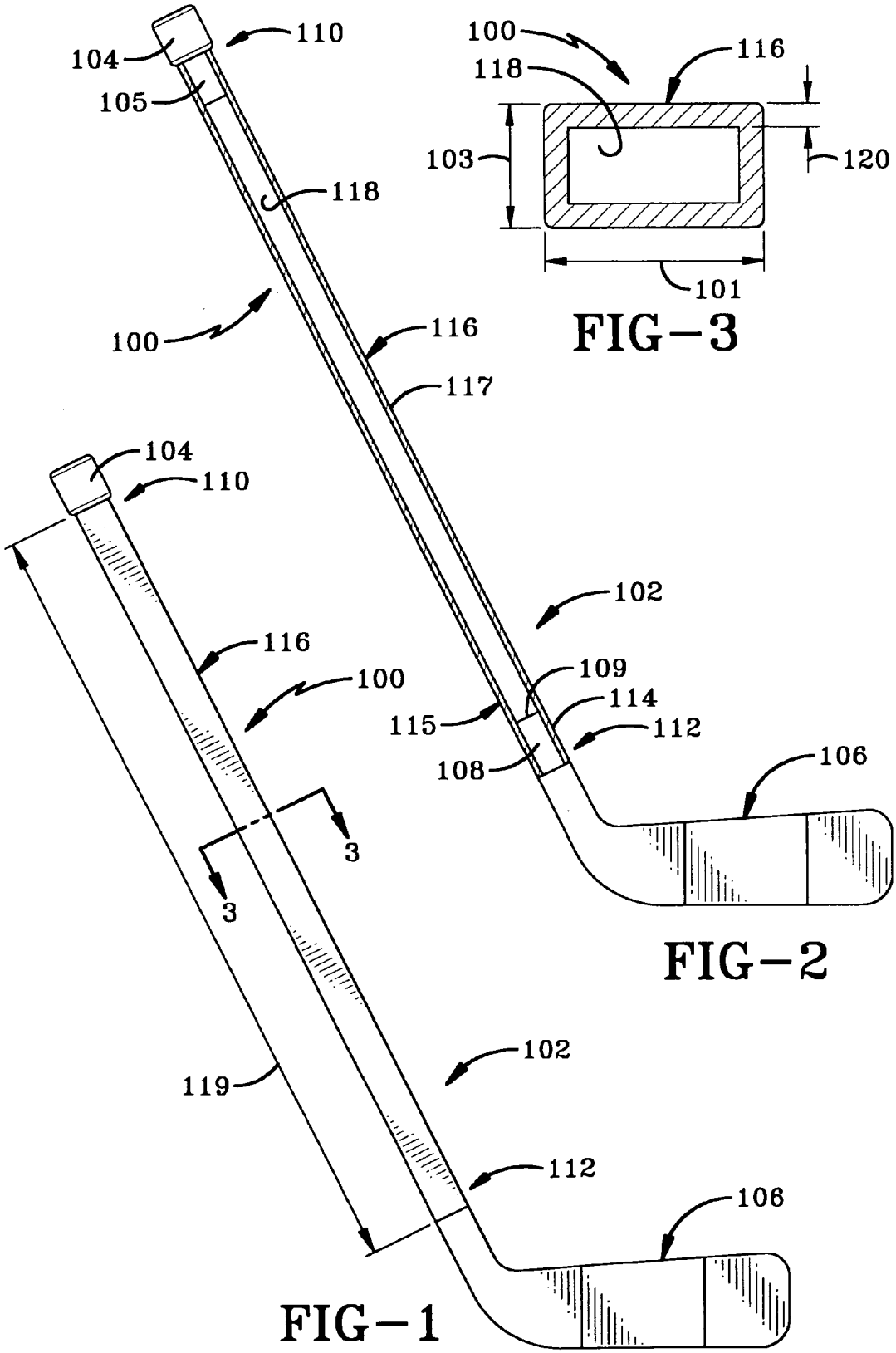
FIG. 1 is a side elevational view of a first embodiment of the present invention.
FIG. 2 is a view similar to FIG. 1 with portions cut away to show a sectional view of the shaft of the first embodiment.
FIG. 3 is an enlarged sectional view taken on line 3—3 of FIG. 1.
Figures 4, 5, 6, 7:
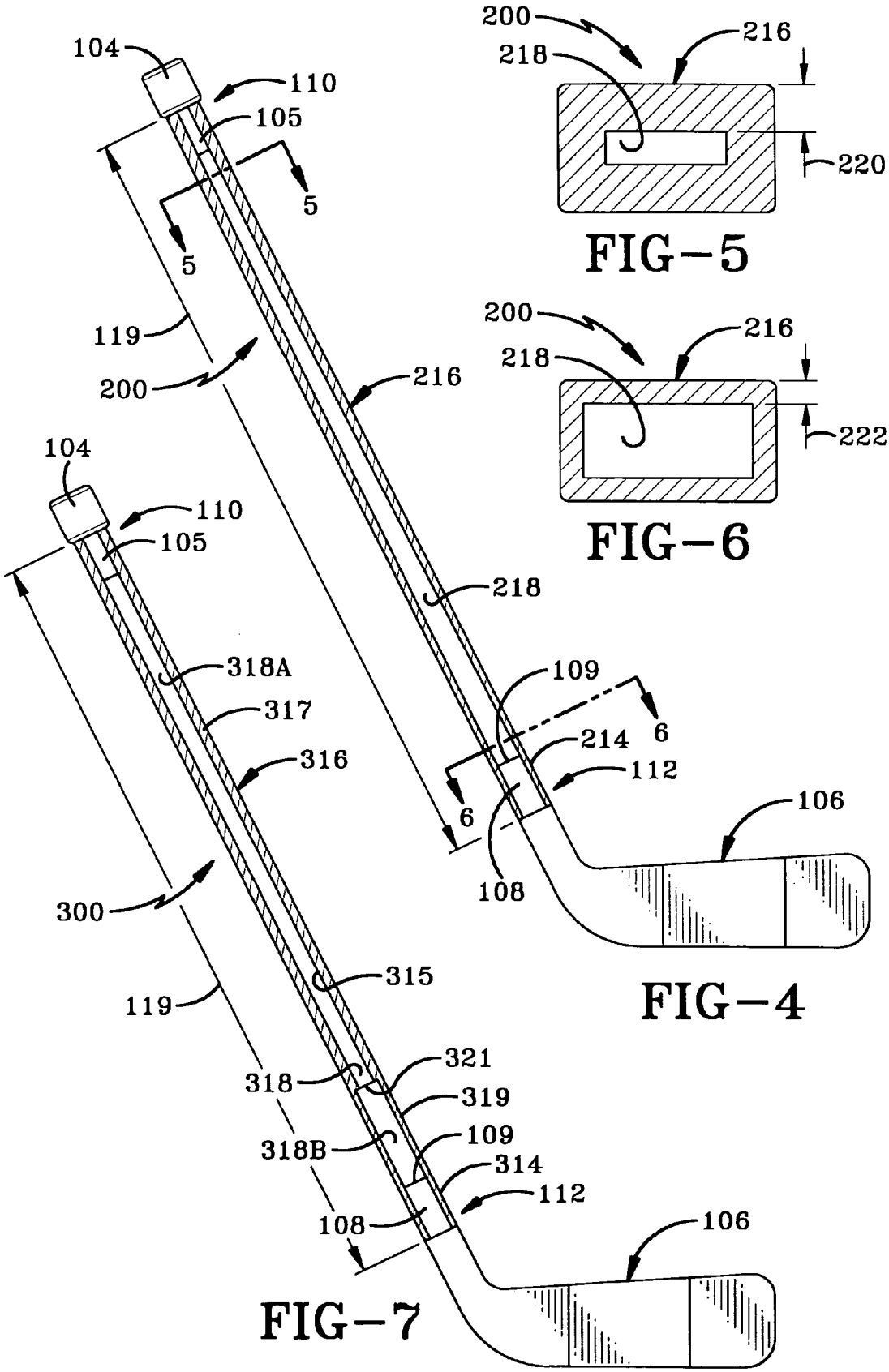
FIG. 4 is a view similar to FIG. 2 of a second embodiment of the present invention.
FIG. 5 is an enlarged sectional view taken on line 5—5 of FIG. 4.
FIG. 6 is an enlarged sectional view taken on line 6—6 of FIG. 4.
FIG. 7 is a view similar to FIG. 2 of a third embodiment of the present invention.
Figure 9:
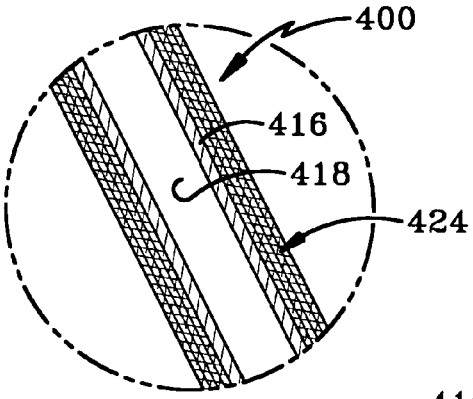
FIG. 9 is an enlarged sectional view of the encircled portion of FIG. 8.
Figure 10:
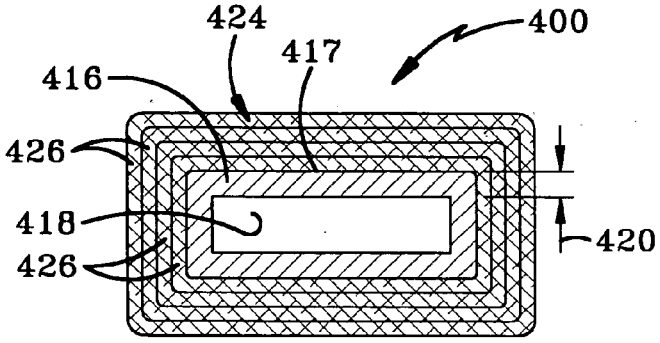
FIG. 10 is an enlarged sectional view taken on line 10—10 of FIG. 8.
Figure 11:
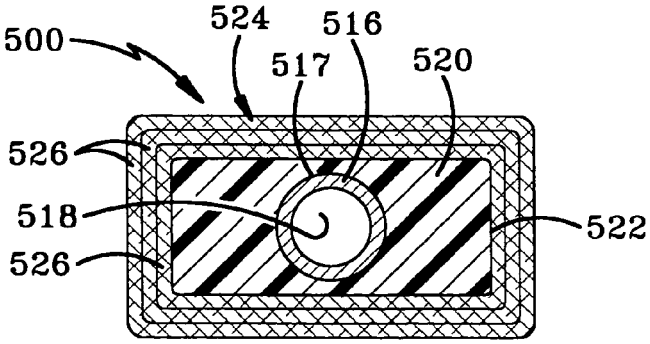
FIG. 11 is an enlarged sectional view of a fifth embodiment of the present invention.
Figure 8:
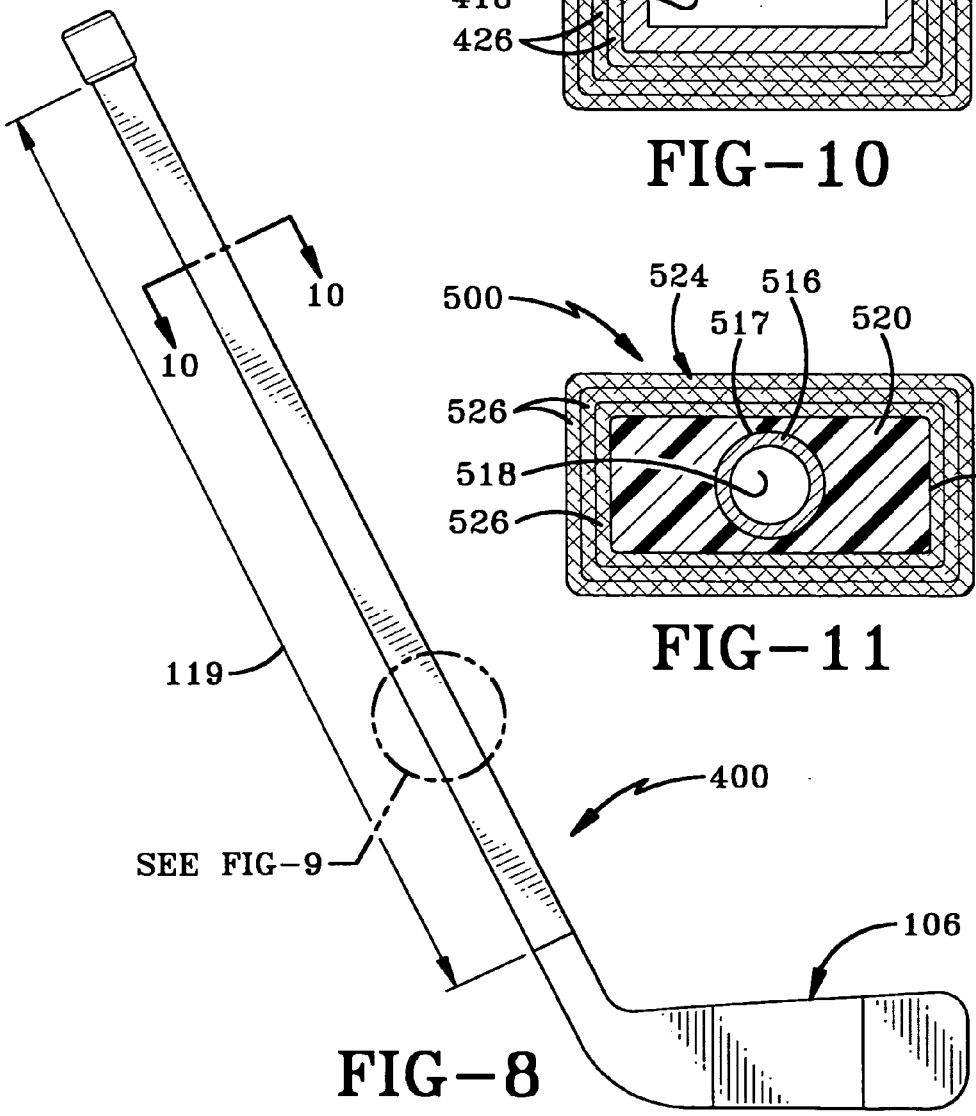
FIG. 8 is a side elevational view of a fourth embodiment of the present invention.

A first embodiment of the hockey stick shaft of the present invention is indicated generally at 100 in FIGS. 1–3; a second embodiment indicated generally at 200 in FIGS. 4–6; a third embodiment indicated generally at 300 in FIG. 7; a fourth embodiment indicated generally at 400 in FIGS. 8–10; and a fifth embodiment indicated generally at 500 in FIG. 11. Shafts 100, 200, 300, 400 and 500 are configured for use with a "player" hockey stick, which for the purposes of this application excludes a goalie or goaltender hockey stick, which, as discussed in the Background section above, serves a different purpose and consequently has a much different configuration and substantially different dynamics.

Shaft 100 is shown in FIGS. 1–2 as part of a player hockey stick 102 which further includes a knob 104 with an insertion shaft 105 and a replaceable player hockey stick blade 106 having an insertion shaft 108 with an upper end 109. Shaft 100 is an elongated one-piece hollow tube formed of unalloyed titanium or a titanium alloy. The tube is substantially rectangular and has a width 101 and a thickness 103 (FIG. 3). Although the dimensions of width 101 and thickness 103 may vary, for typical regulation player hockey sticks, width 101 does not exceed 3 centimeters (1.18 inches) and thickness 103 does not exceed 2.5 centimeters (0.984 inch), in accordance with the Rules of USA Hockey and of the National Hockey League, the sanctioning bodies for most hockey play in the United States. Other league rules may limit these dimensions differently or may not specify such limitations. Shaft 100 has an upper end 110 which receives insertion shaft 105 of knob 104 and a lower end 112 which defines a hosel portion 114 which receives insertion shaft 108 of blade 106. Blade 106 is most commonly connected to shaft 100 with hot glue although other attaching means known in the art may be used. Shaft 100 has a flex point 115 just above hosel portion 114, that is, just above upper end 109 of insertion shaft 108. Shaft has a midpoint 117 between ends 110 and 112 and a length 119 extending the full distance between ends 110 and 112. Length 119 typically ranges from 36 to 58 inches, more preferably from 45 to 58 inches and even more preferably, from 45 to 55 inches. Length 119 differs to suit the size of the player and for purposes of most league play, is limited by rules indicating that hockey sticks will not exceed 63 inches from the heel to the upper end of the shaft (according to rules of USA Hockey and the National Hockey League). Thus, length 119, to comply with such rules, would be limited so that shaft 100 in combination with the pertinent part of the blade would fall within the length from the heel to the end of the shaft. Shaft 100 has an elongated wall 116 which is formed integrally of one piece and defines an elongated interior chamber 118. Wall 116 has a rectangular cross section and a thickness 120 (FIG. 3) which is substantially uniform over the entire length 119 of shaft 100. Wall 116 has an outer perimeter which is substantially uniform from upper end 110 to lower end 112.

More particularly, the titanium or titanium alloy of shaft 100 is of an alpha, a near-alpha, an alpha-beta or a highly-aged beta type. The titanium or titanium alloy has an elastic modulus which is greater than 13 million pounds per square inch (psi), preferably greater than 14 million psi and more preferably greater than 15 million psi. The relatively high elastic modulus provides suitable stiffness to the shaft. The titanium alloy has a yield strength above roughly 50,000 psi, preferably above 60,000 psi and more preferably above 70,000 psi. This range of yield strength is required to adequately resist impact damage and avoid shaft bowing or permanent distortion. The thickness 120 of wall 116 is in the range of 0.020 to 0.045 inches and preferably in the range of 0.025 to 0.035 inches. These wall thickness ranges allow for a favorable combination of shaft stiffness, damage resistance and weight. More detailed information about the unalloyed and alloyed titanium used and the characteristics thereof with regard to hockey stick shafts is provided following the description of all the embodiments of the shaft of the present invention.

Shaft 200 (FIGS. 4–6) is similar to shaft 100 except it has a variable-thickness wall. Shaft 200 is formed of the titanium or titanium alloys noted with regard to shaft 100 with the same range of elastic modulus, yield strength and wall thickness. Adjacent lower end 112, shaft 200 defines a hosel portion 214 which receives insertion shaft 108 of blade 106. Shaft 200 has an elongated wall 216 which is formed integrally of one piece and defines an elongated interior chamber 218 which tapers at a uniform rate outwardly and downwardly from upper end 110 toward lower end 112. Wall 216 has an outer perimeter which is substantially uniform from upper end 110 to lower end 112. Wall 216 has a rectangular cross section and tapers downwardly and inwardly from upper end 110 toward lower end 112. Thus, wall 216 is thicker adjacent upper end 110, as represented by a first thickness 220 (FIG. 5), than adjacent lower end 112, as represented by a second thickness 222 (FIG. 6). More particularly, second thickness 222 is spaced upwardly from hosel portion 214. This thinner section of wall 216 adjacent and above hosel portion 214 provides increased flex for "kick-off" while the thicker sections of wall 216 closer to upper end 110 provide a stiffer upper shaft portion, thus providing improved snap (high energy transfer to the puck) and control of the hockey puck in passing and shooting. A modified wall may be tapered inwardly on its outer surface instead of its inner surface to achieve similar thicker and thinner wall portions.

Shaft 300 is similar to shaft 100 except for the configuration of wall 316. Shaft 300 is formed of the titanium or titanium alloys noted with regard to shaft 100 with the same range of elastic modulus, yield strength and wall thickness. Adjacent lower end 112, shaft 300 defines a hosel portion 314 which receives insertion shaft 108 of blade 106. Wall 316 has an upper portion 317 having a substantially uniform thickness which is greater than the thickness of a lower portion 319 which also has a substantially uniform thickness. The thickness of upper portion 317 and the thickness of lower portion 319 each fall within the wall thickness range noted above, that is, as detailed with regard to shaft 100. Wall 316 has an inner surface 315 defining an interior chamber 318 which is divided into an upper chamber 318A defined by upper portion 317 and a lower chamber 318B defined by lower portion 319. Upper portion 317 steps outwardly along inner surface 315 into lower portion 319 at step 321. Similar to second thickness 222 of shaft 200, lower portion 319 has a decreased thickness which extends upwardly from hosel portion 314 and which is thus above and adjacent hosel portion 314. Similar to shaft 200, this thinner section of wall 316 adjacent and above hosel portion 314 provides increased flex while thicker upper portion 317 provides a stiffer upper shaft portion, thus providing the improved snap and control noted above. A modified wall may be stepped inwardly on its outer surface instead of its inner surface to achieve similar thicker and thinner wall portions.

With regard to shafts 100–300, as illustrated in part by shafts 200 and 300, the shaft walls may be selectively thinned in areas to create flex points. These flex points may occur at various locations along the shaft in addition to the noted flex points adjacent and above respective hosel portions 214 and 314 of shafts 200 and 300. On the other hand, it may be desired to have a thicker wall in certain areas of the shaft, for instance, in the hosel portion in order to provide additional strength against cracking in this high-stress area. As is known in the art, stiffness and flexibility may also be controlled by fillers at desired places within the hollow shafts.

Shaft 400 (FIGS. 8–10) is similar to shaft 100 except that shaft 400 combines a titanium or titanium alloy shaft with composite materials to provide additional advantages. In addition, the range of dimensions and specific unalloyed titanium or titanium alloys which may be used with shaft 400 vary somewhat from those used with shaft 100, as further detailed below. Shaft 400 includes an elongated one-piece hollow tube formed of unalloyed titanium or a titanium alloy, although it may be formed in sections joined together by, for example, welding, brazing, adhesive bonding and/or mechanical fasteners. Shaft 400 has an elongated wall 416 which has an outer surface 417 and is formed integrally of one piece and defines an elongated interior chamber 418. Wall 416 has a rectangular cross section and a thickness 420 (FIG. 10) which is substantially uniform over the entire length of shaft 400, although this may vary, as with the previous embodiments, for example.

Shaft 400 also includes composite material 424, shown as a plurality of layers 426, which encases wall 416 and is bonded to outer surface 417 of wall 416. The tube of shaft 400 serves as an internal support or core of shaft 400 and as a non-removable mandrel for the application of uncured fiber-reinforced composite materials via traditional sheet-rolling, sheet-wrapping or filament winding methods. (See, for example, U.S. Pat. No. 6,354,960). Composite material 424 is bonded to outer surface 417 during thermal curing of composite material 424. This hybrid composite-titanium hockey shaft provides improved durability and impact-damage-resistance compared to all-composite shafts while providing stiffness control and maintaining light-weight and highly dynamically-responsive shaft properties.

The titanium or titanium alloy forming the core of shaft 400 is of an alpha, a near-alpha, an alpha-beta or a beta type. In comparison to shafts 100, 200 and 300, the elastic modulus of the titanium or titanium alloy of shaft 400 is not as critical because the composite material is configured to provide suitable stiffness to shaft 400. Thus, a titanium or titanium alloy having an elastic modulus substantially lower than the ranges noted with regard to the previous embodiments may be used, although said ranges are very well suited to shaft 400 as well. The titanium alloy has a yield strength above roughly 40,000 psi, although the higher strengths noted above are preferred. The thickness of wall 420 is in the range of 0.010 to 0.040 inches and may uniform or variable. The combination of a titanium-based core with a composite external material retains the positive characteristics of the composite material while adding the titanium-related characteristics, particularly the ability to better withstand impact damage which so often renders all-composite shafts non-functional. In addition, the use of the titanium or titanium core as a non-removable mandrel greatly simplifies the formation of the titanium-composite shaft in comparison to the formation of an all-composite shaft, which requires the more difficult, added task of removing a mandrel.

Shaft 500 (FIG. 11) is similar to shaft 400 except that shaft 500 includes an intermediate structure 520 between a cylindrical core and composite material. The core of shaft 500 is formed of the titanium or titanium alloys noted with regard to shaft 400 with the same range of yield strength and wall thickness. The elastic modulus characteristics of shaft 500 are also the same as noted with regard to shaft 400. The core of shaft 500 has an elongated wall 516 which has an outer surface 517 and defines an elongated interior chamber 518. Intermediate structure 520 is bonded to outer surface 517 and has an outer surface 522. Shaft 500 includes composite material 524, shown as a plurality of layers 526, which is bonded to outer surface 522 of structure 520, thereby encasing intermediate structure 520 and wall 516 with intermediate structure 520 disposed between wall 516 and composite material 520. Intermediate structure 520 may be formed of a wide variety of materials, for example, a polymeric material which may be foamed or solid, an elastomer, or wood. Most preferably, such a material is light weight in order to maintain a light weight shaft while taking advantage of characteristics of the titanium core and composite outer layer. Structure 520 provides the additional benefits of a third material between wall 516 and composite material 524 and permits the use of cores with various shapes to be built up to provide a rectangular cross-section suited to produce a rectangular shaft while retaining the advantages of the composite-titanium combination.

With regard to shafts 400 and 500, the cross sectional shape of the tube may be any other suitable shape, for example, oval, square or triangular. Further, with regard to composite-titanium shafts such as shafts 400 and 500, where the titanium or alloy thereof serves as an internal reinforcement structure, the tube may be flattened, corrugated, tapered, stepped, slotted and so forth. Alternately, the tube may be replaced with a non-tubular internal structure which is flat, corrugated, tapered, stepped, slotted and so forth. These varying configurations of the core allow modification of the rigidity of given sections and/or the net weight of the tube.

With regard to shafts 400 and 500 and similar composite-titanium hybrid shafts, the composite material may be applied along the shaft tube or other internal structure in various thicknesses and with fibers extending in different directions in order to control and optimize the dynamic response of the hockey stick shaft and/or blade. Stiffness and flex points may be controlled in this manner. In addition, the internal titanium structure may be selectively thinned in areas to create flex points.

Table 1 below compares some of the pertinent properties of various commercial grade unalloyed titanium and titanium alloys.

TABLE 1

Property Comparison of Various Types of Commercial Titanium Alloys

| Titanium Alloy Type | Alloy (ASTM Grade) | Min. YS ($10^3$ psi) | Elastic Modulus ($10^6$ psi) | Density (g/cm$^3$) |
|---|---|---|---|---|
| Alpha | Unalloyed Ti (Gr. 1) | 25 | 15.1 | 4.51 |
| | Unalloyed Ti (Gr. 2) | 40 | 15.1 | 4.51 |
| | Unalloyed Ti (Gr. 3) | 55 | 15.2 | 4.51 |
| | Unalloyed Ti (Gr. 4) | 70 | 15.3 | 4.51 |
| | Ti-0.3Mo-0.8Ni (Gr. 12) | 50 | 15.1 | 4.51 |
| | Ti-5Al-2.5Sn (Gr. 6) | 115 | 17 | 4.48 |
| Near-alpha | Ti-3Al-2.5V (Gr. 9) | 70 | 15.5 | 4.48 |
| | Ti-6Al-2Sn-4Zr-2Mo-0.1Si | 120 | 16.5 | 4.54 |
| Alpha-beta | Ti-6Al-4V ELI (Gr.23) | 110 | 16.5 | 4.43 |
| | Ti-6Al-4V (Gr. 5) | 120 | 16.5 | 4.43 |
| | Ti-4.5Al-3V-2Mo-2Fe | 120 | 15.9 | 4.54 |
| | Ti-6Al-2Sn-2Zr-2Mo-2Cr-0.15Si | 160 | 17.0 | 4.65 |
| Beta | Ti-15V-3Al-3Cr-3Sn | 110–160 | 12–15 | 4.76 |
| | Ti-3Al-8V-6Cr-4Zr-4Mo | 115–160* | 13–15 | 4.82 |
| | Ti-15Mo-2.5Nb-3Al-0.2Si | 115–160* | 13–15 | 4.94 |

*Can be aged to various minimum yield strength values.

To help determine the thickness of the wall 120, shaft flexure (stiffness) behavior of titanium and aluminum as a hollow rectangular tube was modeled. This model was based on a typical hockey stick shaft bend loading scenario using a 50-inch shaft. In this model, the shaft is loaded in bending (as when shooting the puck) by a player's lower hand across the smaller dimension (as at thickness 103 of shaft 100) of the rectangular cross section approximately at the midpoint, as at midpoint 117 of shaft 100. Because a two- to three-inch wooden knob is typically inserted in the upper end of the shaft, the unsupported span for shaft flexing in this model is approximately 47.0 to 47.5 inches. While there are no formal standards for ice hockey sticks, the stiffness is often defined in the industry as the force (in pounds) to bend a shaft to a one-inch deflection at the load point (i.e., the midpoint). The typical stiffness for wood, aluminum and composite shafts range from approximately 70 to 120 pounds per inch of deflection, with approximately 100 pounds per inch of deflection being most popular. Results of this model are shown in Table 2 below, and include a comparison of titanium, aluminum, composite and wood shafts.

TABLE 2

Comparison of Hockey Stick Shaft Materials

| Shaft Material | Shaft Dimensions (in) | 70 lb/in Stiffness Wall (in) | 70 lb/in Stiffness Wt (g) | 85 lb/in Stiffness Wall (in) | 85 lb/in Stiffness Wt (g) | 100 lb/in Stiffness Wall (in) | 100 lb/in Stiffness Wt (g) |
|---|---|---|---|---|---|---|---|
| N. White-ash (wood) | 1.15 × 0.80 × 47.5 | — | — | — | — | Solid | 459* |
| Aluminum | 1.05 × 0.72 × 47.5 | 0.034 | 244 | 0.042 | 299 | 0.051 | 359 |
| | 1.15 × 0.76 × 47.5 | 0.031 | 242 | 0.038 | 294 | 0.047 | 360 |
| Composite | 1.16 × 0.76 × 47.5 | 0.078–0.093 | 290–340 | 0.078–0.093 | 290–325 | 0.078–0.093 | 290–340 |
| Titanium-unalloyed | 1.05 × 0.72 × 47.5 | 0.021 | 255 | 0.026 | 314 | 0.032 | 383 |
| | 1.05 × 0.76 × 47.5 | 0.019 | 236 | 0.023 | 285 | 0.028 | 345 |
| | 1.05 × 0.80 × 47.5 | 0.016 | 204 | 0.020 | 254 | 0.025 | 316 |
| | 1.15 × 0.72 × 47.5 | 0.020 | 257 | 0.024 | 307 | 0.029 | 369 |
| | 1.15 × 0.76 × 47.5 | 0.017 | 224 | 0.021 | 275 | 0.025 | 326 |
| | 1.15 × 0.80 × 47.5 | 0.015 | 202 | 0.019 | 255 | 0.022 | 294 |
| Ti-3Al-2.5V (near-alpha Ti alloy) | 1.05 × 0.72 × 47.5 | 0.020 | 241 | 0.025 | 300 | 0.030 | 358 |
| Ti-6Al-4V (alpha-beta Ti alloy) | 1.05 × 0.72 × 47.5 | 0.020 | 239 | 0.024 | 285 | 0.029 | 342 |
| Ti-15-3-3-3 (beta Ti alloy) | 1.05 × 0.72 × 47.5 | 0.024 | 306 | 0.030 | 380 | 0.036 | 453 |

*For a 47.5" shaft length only.

This model was used to determine the wall thickness needed to achieve certain shaft stiffness values. The model results revealed that it is possible to achieve equivalent stiffness with substantially thinner walls and often lower net shaft weights than aluminum and composites. The higher-density/lower-modulus beta titanium alloys are an exception, being significantly heavier than aluminum and composite shafts. Surprisingly, because of the desire to keep the weight of the shaft within such a low range, some of the walls became so thin that it was necessary to increase the elastic modulus in order to maintain sufficient shaft stiffness, whereas normally it would be expected that a metal shaft would be stiff enough to require a lower elastic modulus. Thus, titanium alloys with sufficiently high elastic modulus were needed in such cases.

It is noted that the shaft weight results determined from the model were only determined with regard to stiffness and do not consider wall thicknesses needed to adequately resist mechanical damage or hosel end overload/cracking. Hockey stick shafts are subject to impact by pucks or hockey sticks of opponents. Thus, resistance to denting and permanent set (yielding) is a pertinent issue. Experience with aluminum alloy shafts shows susceptibility to some denting. Further, repeated use of aluminum alloy sticks, particularly as a result of slap shots, can slowly bow or deform the shafts, implying that the aluminum alloy yield strength was exceeded.

Table 3 below shows a dent resistance comparison of aluminum alloy and unalloyed titanium hollow shafts. Based on elastic strain energy theory, the intrinsic resistance to permanent impact damage of a thin-wall surface is proportional to the square of the yield strength (YS) multiplied by the wall thickness (t) divided by the elastic modulus (E). Table 3 compares an aluminum alloy (e.g., 2004 or 7005) with typical wall thicknesses of 0.045 and 0.050 inches with titanium walls having respective thicknesses of 0.025, 0.030 and 0.033 inches.

TABLE 3

Dent Resistance Comparison: Al Alloy vs. Unalloyed Ti Hollow Shafts $$\text{Denting resistance (yielding on impact)} \propto \frac{(YS)^2}{E} \times t$$

where t = wall thickness

YS = nominal yield strength

E = elastic modulus

| Alloy | YS ($10^3$ psi) | E ($10^6$ psi) | Wall (t) (in.) | Relative Dent Resistance |
|---|---|---|---|---|
| Al 2024 or 7005 | 50 | 10.5 | 0.045 | 10.7 |
| | | | 0.050 | 11.9 |
| Gr. 2 Ti | 50 | 15.1 | 0.025 | 4.1 |
| | | | 0.030 | 5.0 |
| | | | 0.033 | 5.5 |
| Gr. 3 Ti | 62 | 15.3 | 0.025 | 6.3 |
| | | | 0.030 | 7.5 |
| | | | 0.033 | 8.3 |
| Gr. 4 Ti | 75 | 15.5 | 0.025 | 9.1 |
| | | | 0.030 | 10.9 |
| | | | 0.033 | 12.0 |
| | 80 | 15.5 | 0.025 | 10.3 |
| | | | 0.030 | 12.4 |
| | | | 0.033 | 13.6 |
| | 85 | 15.5 | 0.025 | 11.7 |
| | | | 0.030 | 14.0 |
| | | | 0 033 | 15.4 |

Table 3 reveals that the softer, lower strength unalloyed titanium Grades 2 and 3 are not expected to resist yielding or denting as well as the conventional aluminum alloy hockey shafts while maintaining the thin walls needed to achieve a desirable weight for the shaft. Impact damage resistance which is comparable to the aluminum shafts occurs with a yield strength in the order of 75,000 psi. To provide improved durability over traditional aluminum alloy shafts, the Grade 4 alloy must be increased to approximately 80,000 psi or above. These findings indicate that the much higher strength alpha-beta titanium alloys and the lower modulus beta titanium alloys will also provide sufficient and improved dent resistance.

In furtherance of determining the various pertinent characteristics of titanium-based shafts, unalloyed titanium shafts of Grade 2 and Grade 4 titanium were subjected to field tests during hockey practice and game play, the results of which are found in Table 4 below. These tests included shafts having wall thicknesses which were uniform, tapered or stepped, as described above with regard to shafts 100, 200 and 300. However, some of the stepped shafts used in the tests involved two steps and subsequently three sections each having a different thickness. The wall thickness of each section of the stepped shafts used in the tests is uniform. As noted in Table 4, the length of the shafts tested ranged from 47.5 to 50.0 inches. The width and thickness of the shafts tested also varied slightly. As also noted in Table 4, some of the shafts were annealed and others were not.

titanium shafts with thinner walls (0.025 inches and below) can experience rapid kinking (unstable shaft buckling/collapse) and breakage from hard slap shots and/or severe stick clashes. Grade 4 titanium shafts with walls above 0.025 inches (stepped or uniform thickness) remained fully functional and intact, and resisted cracking, kinking, failure and bowing (permanent deformation). Shallow denting did not appear to influence shaft life or performance. In fact, shafts incurring fairly substantial denting during use subsequent to the above-noted field tests have remained fully functional. The survivability of these shafts under the rigors of actual playing conditions was unexpected given such thin walls. Shaft tube weld seams and hosel end areas remained undeformed, uncracked and fully intact. The standard hot glue for attaching the blade to the shaft worked well with the titanium shafts and was unaffected by hosel zone heating cycles. Based on these tests, it was found that the shafts which were viable under actual playing conditions and also had a desirable weight fell within a rough weight range of

TABLE 4

Field Performance of Prototype Titanium Hockey Stick Shafts

| Ti Alloy (condition) | Shaft Width × Thickness (in.) | Wall Thickness (in.) ‡ | Shaft Length (in.) | Shaft Weight (g) | No. Times Used** | Performance Ratings |
|---|---|---|---|---|---|---|
| Gr. 2 Ti (annealed) | 1.02 × 0.73 | 0.031 | 47.6 | 349 | 2 | C |
| Gr. 2 Ti (annealed) | 1.02 × 0.73 | 0.031 | 47.9 | 351 | 3 | A |
| Gr. 4 Ti (not annealed) | 1.03 × 0.76 | 0.025 | 48.1 | 286 | 2 | D |
| Gr. 4 Ti (not annealed) | 1.03 × 0.75 | 0.025 | 48.0 | 286 | 1 | A |
| Gr. 4 Ti (annealed) | 1.06 × 0.76 | 0.033 | 47.5 | 368 | 2 | A |
| Gr. 4 Ti (annealed) | 1.06 × 0.76 | 0.033 | 50.0 | 388 | 23 | A, B |
| Gr. 4 Ti* (annealed) | 1.05 × 0.76 | 0.033 (30")<br>0.026 (17") | 50.0 | 369 | 6 | A |
| Gr. 4 Ti* (annealed) | 1.05 × 0.76 | 0.033 (27.5")<br>0.026 (17") | 47.5 | 354 | 7 | A |
| Gr. 4 Ti* (annealed) | 1.05 × 0.76 | 0.033 (25.5")<br>0.027 (19") | 47.5 | 352 | 16 | A |
| Gr. 4 Ti* (not annealed) | 1.05 × 0.76 | 0.033 (27.5")<br>0.028 (17") | 47.5 | 347 | 6 | A, B |
| Gr. 4 Ti* (not annealed) | 1.05 × 0.76 | 0.033 (27.5")<br>0.030 (17") | 47.5 | 359 | 9 | A, B |
| Gr. 4 Ti* (annealed) | 1.05 × 0.76 | 0.033 (30")<br>0.031 (12")<br>0.028 (5") | 50.0 | 375 | 12 | A, B |
| Gr. 4 Ti* (annealed) | 1.05 × 0.76 | 0.033 (30")<br>0.031 (13")<br>0.028 (5") | 50.0 | 377 | 6 | A, B |

Legend:
A - No cracking or bowing, remained intact and fully functional
B - Exhibited shallow denting, but remained fully functional
C - Experienced noticeable bowing (permanent distortion)
D - Experienced buckling/collapse/kinking and complete failure
*Indicates a shaft incorporating multi-step wall thicknesses
**Each time typically consisted of an hour of either team practice or an actual game at the high school or adult league level
‡ Numbers in parentheses indicate the length of the shaft section having the indicated wall thickness; the first parenthetical number corresponding to a first section extending downwardly from the upper end of the shaft, the second parenthetical number corresponding to a second section adjacent and below the first section, and the third parenthetical number, if any, corresponding to a third section adjacent and below the second section; the hosel portion, not indicated, is adjacent and below the second section (or third section, if any) and is 3 inches long The field tests indicated that Grade 2 titanium shafts may experience noticeable bowing and permanent distortion or yielding from hard slap shots and/or severe stick clashing, even at wall thicknesses as high as 0.031 inches. Further, 280 to 400 grams. Based on these results, viable shafts having a length in the range of 45 to 58 inches would be expected to have respective weights in the range of roughly 250 to 450 grams. Weight ranges for viable shafts of other lengths may be similarly calculated. Viable shafts may be possible below these weight ranges by reducing the shaft width and/or thickness, although these dimensions must be sufficiently large to ensure a proper grip on the shaft, absent building the shaft up with other materials.

The field tests also produced feedback from players using the tested sticks. This feedback indicated that the sticks were lightweight, very flexible and had a rugged durable feel. Unlike aluminum shafts, there were no vibration or harmonic issues related to the titanium shafts. This was an unexpectedly good result, because metals, due to their low dampening capacity, are normally expected to create undesirable vibrations and harmonic issues, but the titanium shafts were free of this type of problem. The sticks were reportedly very responsive and had excellent snap in wrist-shots (high energy transfer to the puck). Good accuracy/puck control was also reported in wrist-shots. The control and feel during puck handling was good and passing accuracy was improved. The tapered and multi-step wall shafts provided improved snap/dynamic response compared to the shafts of uniform wall thickness.

Table 5 below summarizes the comparative characteristics of hockey stick shafts made of various materials. As easily discerned from Table 5, the titanium or titanium alloy shafts have desirable characteristics across the board, other than the low to medium cost of manufacturing, which is really more of a neutral feature and in contrast with the typical expectation of high cost for titanium products in general. Even if the cost to manufacture were high, it would be offset by the low life cycle cost due to the longer projected service life. The ability to provide all these desirable characteristics with a titanium shaft in contrast to the other materials is a substantial breakthrough in the advancement of hockey sticks.

TABLE 5

Comparison of Hockey Stick Shaft Materials

| | Shaft Material | | | |
|---|---|---|---|---|
| Property/Aspect | Wood | Aluminum | Composite | Titanium |
| Weight | high | high | **low** | **low** |
| Performance Consistency | low | **high** | **high** | **high** |
| Damage Resistance (durability) | low | medium | low | **high** |
| Projected Service Life | low | medium | low | **high** |
| Long-term Stability (shelf life/temperature resistance) | low | **high** | medium | **high** |
| Energy Transfer (snap) | low | medium | **high** | **high** |
| Cost to Manufacture | **low** | low–med | med–high | low–med |
| Life Cycle Cost | med–high | **low** | high | **low** |

Note:
Underlined indicates a negative or undesirable feature.
Bold-face type indicates a positive or desirable feature.

In summary, shafts 100, 200, 300, 400 and 500 are lighter than conventional wood or aluminum hockey stick shafts of equivalent length and approach or are similar to the weight of all-composite shafts. Despite the thin walls of these titanium shafts, they are more dynamically responsive and provide improved energy transfer from the stick to the puck than conventional wood and aluminum shafts. Also in spite of the thin walls of the titanium shafts, they are substantially more physically durable and impact-damage-resistant than wood and composite shafts. They are also more heat-resistant than wood and composite shafts. Thus, the service life of these improved shafts is substantially lengthened. Because blades and knobs are replaced using hot glue procedures, it is important that these shafts do not suffer heat damage.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A player hockey stick shaft comprising:

an elongated one-piece wall forming a titanium or titanium alloy hollow tube having an upper end and a lower end adapted to receive a player hockey stick blade therein; wherein the titanium or titanium alloy has an elastic modulus greater than 13 million psi and a yield strength above 50,000 psi; and wherein the wall has a thickness in the range of 0.020 to 0.045 inches.

2. The shaft of claim 1 wherein the titanium or titanium alloy has a yield strength above 70,000 psi.

3. The shaft of claim 2 wherein the wall has a thickness in the range of 0.025 to 0.035 inches.

4. The shaft of claim 3 wherein the wall has a length in the range of 45 to 58 inches.

5. The shaft of claim 1 wherein the titanium or titanium alloy has an elastic modulus greater than 15 million psi.

6. The shaft of claim 5 wherein the titanium or titanium alloy has a yield strength above 70,000 psi.

7. The shaft of claim 6 wherein the wall has a thickness in the range of 0.025 to 0.035 inches.

8. The shaft of claim 1 wherein the wall has a length in the range of 45 to 58 inches.

9. The shaft of claim 1 wherein the wall has a thickness in the range of 0.025 to 0.035 inches.

10. The shaft of claim 9 wherein the tube is substantially rectangular in cross section and has a width and a thickness; and wherein the wall has a stiffness requiring a force ranging from 70 to 120 pounds applied across the thickness of the tube at a midpoint between the upper and lower ends of the wall to bend the wall to a one-inch deflection at the midpoint.

11. The shaft of claim 10 wherein the wall has a length ranging from 45 to 58 inches; and wherein the wall has a weight ranging from 250 to 450 grams.

12. The shaft of claim 1 wherein the titanium or titanium alloy is of an alpha, a near-alpha, an alpha-beta or a highly-aged beta type.

13. The shaft of claim 1 wherein the wall includes a hosel portion adapted to receive the blade and extending upwardly from the lower end; and wherein the wall has a first thickness adjacent the upper end and a second thickness above and adjacent the hosel portion which is less than the first thickness.

14. The shaft of claim 13 wherein the wall tapers inwardly and downwardly from adjacent the upper end to adjacent the lower end.

15. The shaft of claim 13 wherein the wall is stepped to define the first and second thicknesses.

16. The shaft of claim 1 wherein the titanium or titanium alloy has an elastic modulus greater than 14 million psi.

17. The shaft of claim 16 wherein the wall has a thickness in the range of 0.025 to 0.035 inches.

18. The shaft of claim 16 wherein the titanium or titanium alloy has a yield strength above 60,000 psi.

19. The shaft of claim 18 wherein the wall has a thickness in the range of 0.025 to 0.035 inches.

20. The shaft of claim 16 wherein the titanium or titanium alloy has a yield strength above 70,000 psi.

21. The shaft of claim 1 wherein the titanium or titanium alloy has a yield strength above 60,000 psi.

22. The shaft of claim 1 wherein the wall has a length ranging from 45 to 58 inches; and wherein the wall has a weight ranging from 250 to 450 grams.

23. The shaft of claim 3 wherein the titanium or titanium alloy has an elastic modulus greater than 14 million psi.

24. The shaft of claim 3 wherein the titanium or titanium alloy has an elastic modulus greater than 15 million psi.

25. The shaft of claim 5 wherein the titanium or titanium alloy has a yield strength above 60,000 psi.

26. The shaft of claim 25 wherein the wall has a thickness in the range of 0.025 to 0.035 inches.

27. The shaft of claim 5 wherein the wall has a thickness in the range of 0.025 to 0.035 inches.

28. The shaft of claim 9 wherein the titanium or titanium alloy has a yield strength above 60,000 psi.

29. The shaft of claim 1 wherein the hollow tube has an outer surface; and wherein the shaft is free of fiber-reinforced composite material bonded to the outer surface of the hollow tube.

* * * * *